US007828120B2

(12) United States Patent
Kocher et al.

(10) Patent No.: US 7,828,120 B2
(45) Date of Patent: Nov. 9, 2010

(54) METHOD OF MODERNIZING AN ELEVATOR INSTALLATION

(75) Inventors: Hans Kocher, Udligenswil (CH); Miroslav Kostka, Ballwil (CH)

(73) Assignee: Inventio AG, Hergiswil NW (CH)

( * ) Notice: Subject to any disclaimer, the term of this patent is extended or adjusted under 35 U.S.C. 154(b) by 531 days.

(21) Appl. No.: 11/782,942

(22) Filed: Jul. 25, 2007

(65) Prior Publication Data

US 2008/0023271 A1 Jan. 31, 2008

(30) Foreign Application Priority Data

Jul. 25, 2006 (EP) ..... 06117767

(51) Int. Cl.
*B66B 9/00* (2006.01)

(52) U.S. Cl. ..... 187/249; 187/383

(58) Field of Classification Search ..... 187/247–249, 187/380–389, 414, 902
See application file for complete search history.

(56) References Cited

U.S. PATENT DOCUMENTS

| | | | | |
|---|---|---|---|---|
| 4,632,224 | A * | 12/1986 | Nowak et al. | 187/387 |
| 5,419,414 | A * | 5/1995 | Sakita | 187/391 |
| 5,749,441 | A * | 5/1998 | Bittar et al. | 187/249 |
| 5,924,524 | A * | 7/1999 | Barker et al. | 187/249 |
| 6,871,727 | B2 * | 3/2005 | Jokela et al. | 187/383 |
| 7,467,691 | B2 * | 12/2008 | Deplazes et al. | 187/249 |
| 2005/0077115 | A1 * | 4/2005 | Urata | 187/383 |
| 2005/0087402 | A1 | 4/2005 | Haegi et al. | |
| 2006/0016640 | A1 * | 1/2006 | Duenser et al. | 187/249 |
| 2007/0039785 | A1 * | 2/2007 | Smith et al. | 187/383 |

FOREIGN PATENT DOCUMENTS

| | | | |
|---|---|---|---|
| EP | 1319624 | A1 | 6/2003 |
| EP | 1489033 | A1 | 12/2004 |
| WO | WO 2004/043842 | A1 | 5/2004 |
| WO | WO 2004/048244 | A1 | 6/2004 |

* cited by examiner

*Primary Examiner*—Walter Benson
*Assistant Examiner*—Eduardo Colon-Santana
(74) *Attorney, Agent, or Firm*—Fraser Clemens Martin & Miller LLC; William J. Clemens

(57) ABSTRACT

A method of modernizing an elevator installation that comprises a first elevator car movable in a shaft by a first drive includes installing at least one second drive without changing the first drive. In addition, at least one second elevator car is installed in the shaft and connected with the second drive. Moreover, a control unit is installed or configured in such a manner that it controls the first drive and the second drive.

11 Claims, 2 Drawing Sheets

METHOD OF MODERNIZING AN ELEVATOR INSTALLATION

FIELD OF THE INVENTION

The present invention relates to a method of modernizing an elevator installation, which comprises an elevator car movable in a shaft by means of a first drive.

BACKGROUND OF THE INVENTION

In countries with a high population density, such as, for example, in the Asiatic area, there are suburbs or city areas in which there are almost exclusively tall apartment blocks or high-rise buildings with up to 20 or 30 floors. These buildings are often significantly over-populated and equipped with an elevator installation having merely one elevator car. A multiplicity of persons thus has to be conveyed within the shortest possible time particularly during the peak times in morning and evening hours. During these peak times the waiting times for the elevator then easily lie within the double-figure minute range. Added to this is the fact that demands for living quality also rise in such areas. However, in most cases the construction of a further elevator shaft does not come into question for reasons of space or costs.

Measures for modernization of elevator installations are known from, for example, EP 1 319 624 A1 and EP 1 489 033 A1. In EP 1 319 624 A1 an elevator installation with two elevator cars movable in separate shafts is retrofitted with a destination call control. The destination call control also comprises several floor terminals for the input of destination call notifications or for recognition of identification codes of the user. Moreover, the destination call control comprises at least one computer unit for evaluation of the destination call notifications or for association of destination floors with recognized destination codes. In addition, a device is provided which uses a destination signal, which is output by the computer unit, in a control signal for control of the respective existing elevator control in order to move the elevator appropriate for serving a destination call. In this manner a building with several elevator shafts can be modernized in such a manner that an additional destination call control is provided so that the elevator movable in a first shaft is modernized with modern floor terminals and at the same time the second elevator movable in the other shaft is, moreover, operated conventionally with a call notification.

In the method, which is described in EP 1 489 033 A1, for modernization of an elevator installation an existing engine room in the region of the shaft head is converted into a passing space. For this purpose initially the engine room floor is removed. Car guide rails and counterweight guide rails are subsequently installed near the walls of the shaft and reach into the newly created passing space. These guide rails are constructed as a self-supporting structure and serve at the same time for supporting the drive and the electrical system. Two elevator cars are subsequently installed and are movable at the common guide rails and independently of one another in the shaft.

In this method for modernization of the elevator installation it has proved disadvantageous that extensive rebuilding measures are required, particularly the demounting of the previous guide rails, installing of new guide rails and demounting of the existing drive with subsequent reattachment of this drive.

SUMMARY OF THE INVENTION

The present invention has an object of proposing a method of modernizing an elevator installation, which has a first elevator car movable in a shaft by means of a first drive, wherein the method enables an increase in the transport capacity of the elevator installation.

According to the present invention for fulfillment of this object in a method of the kind stated in the introduction the method comprises the following steps:

a) installing at least one second drive without changing the first drive;

b) installing at least one second elevator car in the shaft;

c) connecting the second drive with the second elevator car; and d) installing and/or configuring a control unit so that this controls the first drive and the second drive.

The method according to the present invention is based on the recognition of modernizing an existing elevator installation, in which a first existing elevator car is movable in a shaft by means of a first drive, in that at least one additional second elevator car with an associated second drive is installed, wherein the first drive remains unchanged, i.e. remains at the originally installed location and maintains the former equipment.

In other words, the present invention primarily proposes, in a shaft of a elevator installation with a first elevator which comprises a first elevator car and a first drive, maintaining this first elevator unchanged and within the scope of modernization installing in the shaft an additional elevator comprising a second elevator car and an associated second drive, wherein depending on the respective need or exchange requirement as few existing subassemblies as possible have to be exchanged or added. The first elevator car can remain completely unchanged. Alternatively, areas possibly visible to the users, such as, for example, the interior space cladding, can be changed or the first elevator replaced entirely by a modern elevator car.

In the preferred variant with installation of a new central control unit and connection of this control unit with the first and second drives a possibility is created of moving the first elevator car and the second elevator car in suitable manner independently of one another. Such a new control unit can, however, also be provided additionally to an existing control. If the existing control is equipped in suitable manner, this can also be retained and configured for control of the first drive and the second drive in correspondence with the new requirements. In order to make this possible, also only individual components of the existing control unit can be exchanged.

Moreover, it can be provided that the already present guide rails for the first elevator car are similarly maintained unchanged. In principle, also the previous communications elements, such as, for example, conventional floor call transmitters, can be maintained in the floors served by the first elevator car after the modernization.

Overall, the method according to the present invention enables an increase in transport capacity, by comparison with the elevator installation which existed in the building prior to the modernization, without building on a further elevator shaft being required. Moreover, the possibility is created of being able to continue to use the original existing elevator at least in restricted operation even during the reconstruction measures for modernization. Depending on the funds available, components of the first elevator, such as, for example, the inner lining of the first elevator car and/or existing floor call transmitters, can also be renewed.

In an advantageous development of the method according to the present invention it is provided that the second elevator car is installed in such a manner that the first elevator and the second elevator car are guided at guide rails of the first elevator car. In this manner it is possible to dispense with exchange of the existing guide rails. This can also be realized, for example, by means of a hydraulic drive for the second drive. In this connection the hydraulic drive can be equipped with a centrally arranged hydraulic piston, with two hydraulic pistons arranged to be laterally parallel or with two hydraulic pistons arranged to be laterally offset.

Advantageously the control unit is configured in such a manner that the first elevator car and the second elevator car are movable independently of one another. This has proved particularly advantageous in order to keep the requisite safety spacings between the first and second elevator cars and for the case that the first and second elevator cars have overlapping areas of responsibility.

In a further advantageous development the control unit is configured in such a manner that the first elevator car and the second elevator car each travel to predetermined floors. It can then be provided, for example, that all destination calls delivered in a floor region which can be traveled to not only by the first existing elevator car, but also by the second additional elevator car are assigned, for example, as a matter of priority to the second elevator car, since this, for example, makes possible faster travel times. Priorities of that kind can also be established on the basis of other operating parameters, for example in dependence on the operating times or the incidence of transport traffic.

Moreover, the control unit can be configured in such a manner that in the modernization phase, i.e. while the steps a) to c) are carried out, the first elevator car travels only to predetermined floors. In other words, the existing elevator installation remains in operation even if with restricted service range, i.e. movable over only a smaller number of floors.

In a further advantageous refinement of the method the control unit is configured in such a manner that the first elevator car can serve a first floor zone and the second elevator car a second floor zone, wherein the first floor zone and the second floor zone preferably have at least one floor in common. In this manner it is possible to create a so-termed interchange zone, i.e., for example, equipping a floor which can be traveled to not only by the first elevator car, but also by the second elevator car. Alternatively, however, this interchange zone can also comprise several floors each able to be served by the first elevator car and the second elevator car.

In a further advantageous development of the method it is provided that the communications elements which exist for use of the first elevator car are replaced by modern communications units. Thus, conventional floor call transmitters comprising merely input means for announcement of the desired travel direction (upwards or downwards) can be replaced by modern destination call panels or destination call terminals. By means of such modern floor destination call panels the user can specify not only the desired travel direction, but also the destination floor. Installation of floor terminals enables, for example, an automatic destination call output by means of a mobile telephone or other, preferably wire-free, communications units. The aforesaid modern communications units are, according to the respective need, disposed in data exchange communication with the control unit by means of wire-bound or wire-free data transmission. Moreover, it can also be provided, for example, that an existing conventional car call transmitter of the first elevator car is replaced by a modern car panel.

With respect to the design of the second drive there can be provided a drive form which is the same as or different from the first drive. Thus, a driving pulley drive or a hydraulic drive can be installed as second drive. Moreover, the second drive can, depending on whether a lower or an upper building zone is to be equipped with an increased transport capacity, be installed in the region of the pit or the head of the shaft.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
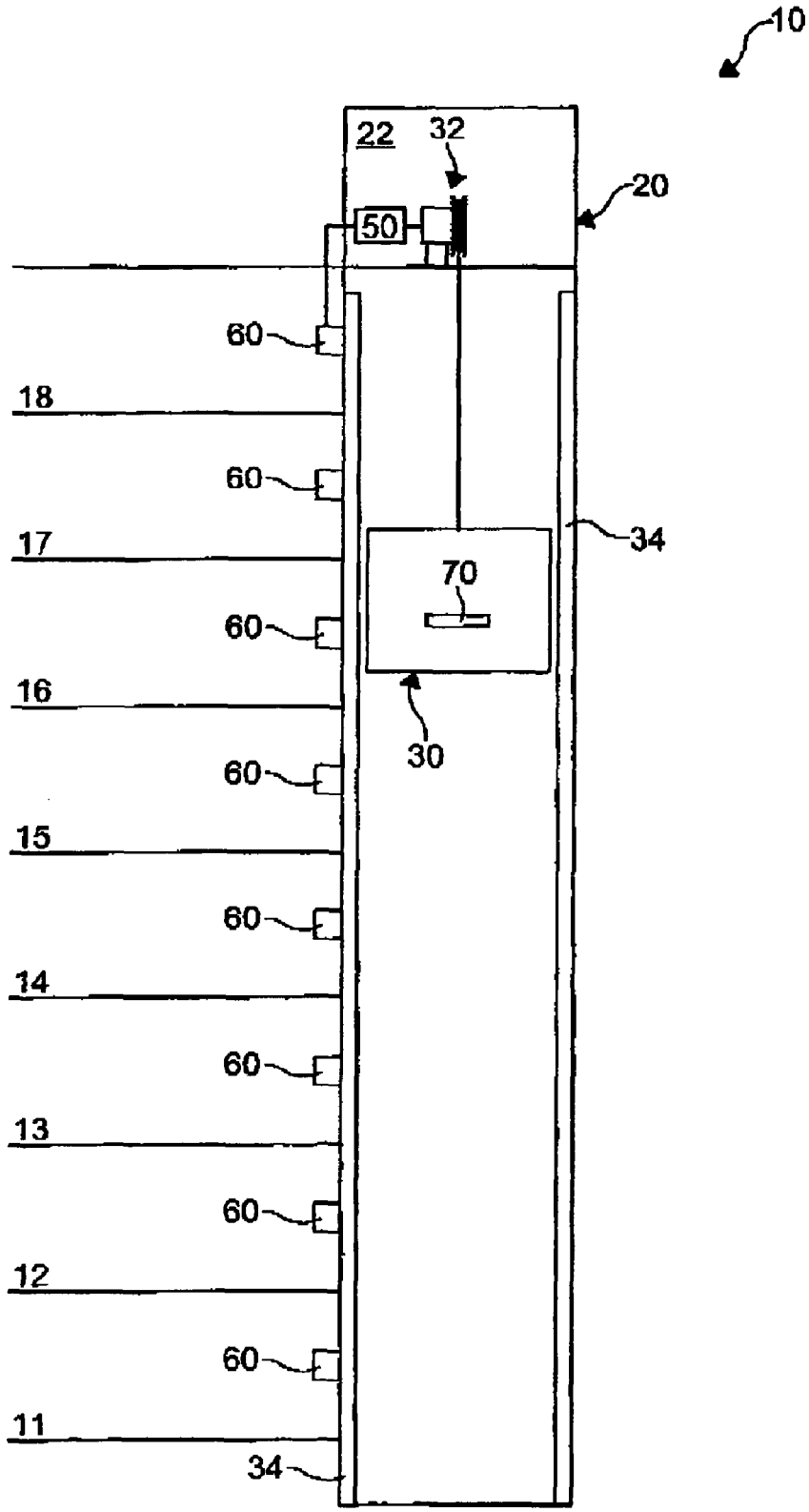
FIG. 1 shows a schematic vertical section through an elevator installation prior to modernization.

FIG. 1 schematically shows an elevator installation 10, which exists in the building, in the form of a passenger elevator. The building has eight floors 11 to 18 which can be reached by persons in the building by way of the elevator installation 10. The existing elevator installation 10 comprises a shaft 20 in which merely a first elevator car 30 is arranged to be upwardly and downwardly movable by means of a first drive 32 in the form of a driving pulley drive. The first drive 32 comprises a motor unit and a brake unit (not illustrated), which are arranged in an engine room 22. Guide rails 34 which guide the first elevator car 30 along its travel path are mounted at the inner side of the shaft walls of the shaft 20.

Disposed on the outer side of the shaft walls on each of the floors is a conventional floor call transmitter 60 comprising an upward button and a downward button, which make it possible for the user to indicate a travel destination direction (upwardly or downwardly). Moreover, the first elevator car 30 is provided with a conventional car call transmitter 70 which makes it possible for the user to deliver, after entering the elevator car 30, a destination call with the desired destination floor.

In addition, the elevator installation 10 comprises an existing control unit 50 connected with the first drive 32. Moreover, the control unit 50 is disposed in data exchange with all floor call transmitters 60 and the car call transmitter 70.

Figure 2:
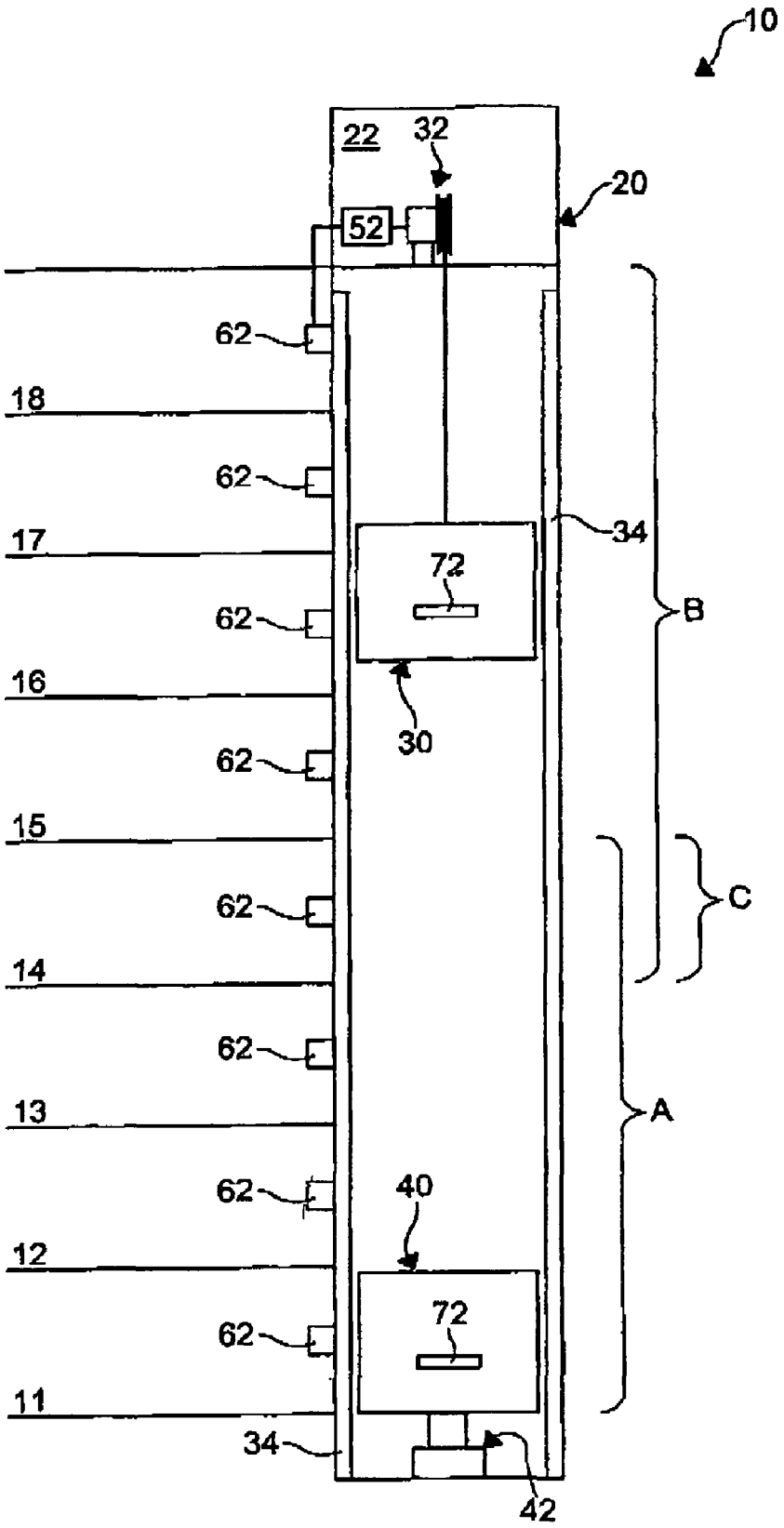
FIG. 2 schematically shows the elevator installation according to FIG. 1 after modernization by the method according to the invention.

On the basis of the afore-described existing elevator installation 10 according to FIG. 1 there is described in the following the method according to the invention for modernization of this elevator installation 10, by which the modernized elevator installation depicted in FIG. 2 is obtained.

In a first step initially the existing control unit 50 is exchanged for a modern control unit 52. Parallel thereto the conventional floor call transmitter 60 and the car call transmitter 70 of the first elevator car 30 are removed and modern floor destination call panels 62 are installed in the region of the floors 11 to 18, and a modern car panel 72 is installed in the first elevator car 30. All floor destination call panels 62 and the car panel 72 are connected with the control unit 52, so that a data exchange is possible. Moreover, the first drive 32 is connected with the control unit 52.

The control unit 52 is equipped in such a manner that it can fulfill not only the functions of the former control unit 50, but also the functions of modern controls. After performance of these operations the elevator installation 10 is already functionally capable again, i.e. the first elevator car 30 could now already accept again a restricted operation, for example only in the upper floors.

Next, the newly installed control unit 52 is placed in the mode "conversion operation", which can be already input in advance or set on site. In this mode the first elevator car 30 is blocked for a specific floor zone which must be kept free for the following installation operations. In addition, a reduced maximum travel speed can also be set. In the case of need, further safety precautions of mechanical nature can also be undertaken, such as, for example, the temporary installation of a safety brake.

A second drive 42 in the form of a hydraulic drive is now installed in the region of the pit of the shaft 20. The hydraulic drive is indicated in FIG. 2 only schematically and can, for example, be equipped with a centrally arranged hydraulic piston, with two hydraulic pistons arranged laterally parallel or two hydraulic pistons arranged laterally offset.

Furthermore, a second elevator car 40 is installed in the shaft. This installation is carried out in such a manner that the second elevator car 40 is guided in the guide rails 34 which already guide the first elevator car 30. The second drive 42 is connected with the second elevator car 40 so that the second elevator car 40 is movable by the second drive 42. The second elevator car 40 is equipped with a modern car panel 72. This car panel 72 and the second drive 42 are connected with the control unit 52.

The now completely modernized elevator installation 10 is illustrated in FIG. 2. According to that, disposed in the shaft 20 are the first elevator car 30 and the second elevator car 40 which are movable upwardly and downwardly independently of one another, wherein the first elevator car 30 is driven by the first drive 32 and the second elevator car 40 by the second drive 42. In this connection the first drive 32 comprises a driving pulley drive and the second drive 42 a hydraulic drive. The driving pulley drive can be constructed as a cable drive or belt drive. Alternatively it can be provided to similarly construct the second drive 42 as a driving pulley drive. In this case the engine room 22 present in the shaft head could accept this second drive 42 without the first drive 32 having to be changed.

In the case of need several test journeys for functional checking of the subsequently installed hydraulic elevator can now be carried out. After successful conclusion of this test operation the mechanical safety measures undertaken for the first elevator car 30 can be uninstalled or the control unit 52 converted from the mode "conversion operation" to the mode "normal operation".

A predetermined floor association for the two elevator cars 30, 40 is provided for the normal operation. In the present example of embodiment, for example, it is provided by way of example that the first elevator car 30 is associated with an upper floor zone B and the subsequently installed second elevator car 40 is associated with a lower floor zone A. In that case the floors 11, 12, 13 and 14 form the first floor zone A and the floors 14, 15, 16, 17 and 18 form the second floor zone B. The two floor zones A, B thus overlap at the floor 14, which forms an interchange zone C. Alternatively, the interchange zone can also comprise several floors. The number of floors associated with the interchange zone C can be variably fixed on the basis of operating parameters such as, for example, the time of day or the incidence of transport traffic. In addition, the position of the individual interchange floor or interchange zone C can be defined to be variable.

Instead of installing the new modern control unit 52, the conventional control unit 50 could, in the alternative, be maintained and so adjusted or configured that it can communicate in suitable manner not only with the first drive 32, but also with the second drive 42. In addition, the conventional floor call transmitters 40 and also the car call transmitter 70 could be retained.

The afore-described variants of the method are distinguished particularly by the fact that with a low outlay, namely with maintenance of the previous elevator car 30 and the associated drive 32, an increase in transport capacity can be achieved in that an additional elevator car 40 and an associated additional drive 42 are installed in the shaft 20. Advantageously, at the same time a modern control unit 52 is installed, which controls the first elevator car 30, the second elevator car 40, the first drive 32 and the second drive 42. Moreover, the method according to the invention makes it possible, during the modernization measures, to maintain an at least restricted operation by the former first elevator car 30.

Finally, it is expressly mentioned that the method, which for the sake of simplicity was explained by means of only one existing first elevator car 30 and one subsequently installed second elevator car 40, for modernization of an elevator installation can be readily carried out also on an elevator installation 10 already comprising several existing elevator cars 30 and also several elevator cars 40 can be subsequently installed.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Method of modernizing an elevator installation, which installation includes an existing first elevator car movable in a shaft by a first drive and an existing control unit for controlling the first drive, comprising the steps of:

a. installing at least a second drive without changing the first drive;

b. installing at least a second elevator car in the shaft;

c. connecting the second drive with the second elevator car;

d. replacing the existing control unit with a new control unit or configuring the existing control unit to control the first drive and the second drive; and e. placing the existing control unit in a conversion operation mode wherein the first elevator car is blocked for a specific floor zone which must be kept free for installation operations according to the steps a. to c.

2. The method according to claim 1 including installing the second elevator car wherein the first elevator car and the second elevator car are guided at guide rails for the first elevator car.

3. The method according to claim 1 including configuring a remaining one of the new control unit and the existing control unit to move the first elevator car and the second elevator car independently of one another.

4. The method according to claim 1 including configuring a remaining one of the new control unit and the existing control unit to cause the first elevator car and the second elevator car to each travel to predetermined floors.

5. The method according to claim 1 including configuring a remaining one of the new control unit and the existing control unit to cause the first elevator car to serve a first floor zone and the second elevator car to serve a second floor zone, wherein the first floor zone and the second floor zone have at least one floor in common.

6. The method according to claim 1 including replacing communications elements existing for use of the first elevator car with modern communications units.

7. The method according to claim 6 including replacing existing floor call transmitters with modern destination call panels or destination call terminals.

8. The method according to claim 6 including replacing an existing car call transmitter of the first elevator car with a modern car panel.

9. The method according to claim 1 including installing a driving pulley drive or a hydraulic drive as the second drive.

10. The method according to claim 1 including installing the second drive in a region of a pit or a head of the shaft.

11. Method of modernizing an elevator installation, which installation includes an existing first elevator car movable in a shaft by a first drive and an existing control unit for controlling the first drive, comprising the steps of:

a. installing at least a second drive without changing the first drive;

b. installing at least a second elevator car in the shaft;

c. connecting the second drive with the second elevator car;

d. placing the existing control unit in a conversion operation mode wherein the first elevator car is blocked for a specific floor zone which must be kept free for installation operations according to the steps a. to c.;

e. replacing the existing control unit with a new control unit or configuring the existing control unit to control the first drive and the second drive; and f. configuring a remaining one of the new control unit and the existing control unit to cause the first elevator car and the second elevator car to each travel to predetermined floors.

* * * * *